US006725636B2

(12) United States Patent
Bates

(10) Patent No.: US 6,725,636 B2
(45) Date of Patent: Apr. 27, 2004

(54) SADDLES

(75) Inventor: Kenneth John Bates, Darlington (AU)

(73) Assignee: Hammersmith Nominees PTY Ltd., Perth (AU)

( * ) Notice: Subject to any disclaimer, the term of this patent is extended or adjusted under 35 U.S.C. 154(b) by 0 days.

(21) Appl. No.: 10/412,814

(22) Filed: Apr. 11, 2003

(65) Prior Publication Data

US 2003/0221397 A1 Dec. 4, 2003

(30) Foreign Application Priority Data

Apr. 12, 2002 (AU) ..... PS1723/2002

(51) Int. Cl.[7] ..... B68C 1/02; B68C 1/04
(52) U.S. Cl. ..... 54/44.3; 54/44.1
(58) Field of Search ..... 54/44.1, 44.3, 54/44.5, 69, 46.2

(56) References Cited

U.S. PATENT DOCUMENTS

| | | | | | |
|---|---|---|---|---|---|
| 734,100 | A | * | 7/1903 | Sena | 54/44.5 |
| 3,343,338 | A | | 9/1967 | Stübben | 54/44.6 |
| 4,033,097 | A | | 7/1977 | Petit | 54/44.6 |
| 4,471,538 | A | | 9/1984 | Pomeranz et al. | 36/28 |
| 4,683,709 | A | * | 8/1987 | Vasko et al. | 54/66 |
| 4,695,496 | A | | 9/1987 | Lee | 54/66 |
| 4,745,734 | A | | 5/1988 | Brown | 428/95 |
| 4,840,425 | A | | 6/1989 | Noble | 54/44.7 |
| 4,974,397 | A | | 12/1990 | Ricken | 54/66 |
| 5,018,341 | A | | 5/1991 | Evertson | 54/66 |
| 5,027,589 | A | | 7/1991 | Gleb et al. | 54/66 |
| 5,179,821 | A | * | 1/1993 | Hiser | 54/44.1 |
| 5,299,412 | A | | 4/1994 | Cudney et al. | 54/66 |
| 5,329,751 | A | | 7/1994 | Wadsworth | 54/23 |
| 5,363,631 | A | | 11/1994 | Garrison | 54/66 |
| 5,383,328 | A | * | 1/1995 | Brown | 54/44.3 |
| 5,517,808 | A | | 5/1996 | Schleese | 54/44.6 |
| 5,555,710 | A | | 9/1996 | Smith | 54/66 |
| 5,685,133 | A | | 11/1997 | Travis | 54/44.7 |
| 5,782,070 | A | | 7/1998 | Knight et al. | 54/66 |
| 5,787,692 | A | | 8/1998 | Purdy | 54/66 |
| 5,802,823 | A | | 9/1998 | Woods | 54/66 |
| 6,050,067 | A | | 4/2000 | Knight et al. | 54/44.6 |
| 6,588,185 | B1 | * | 7/2003 | Goblet | 54/44.3 |

FOREIGN PATENT DOCUMENTS

| | | |
|---|---|---|
| AU | 23770/92 | 11/1993 |
| AU | 49621/93 | 8/1994 |
| CH | 446 045 | 3/1968 |
| DE | 2 133 034 | 1/1973 |
| DE | 2 259 376 | 6/1974 |
| DE | 24 28 852 | 1/1976 |
| DE | 40 36 907 | 5/1992 |
| DE | 41 00 027 | 7/1992 |
| DE | 41 14 433 | 11/1992 |

(List continued on next page.)

*Primary Examiner*—Charles T. Jordan
*Assistant Examiner*—Elizabeth Shaw
(74) *Attorney, Agent, or Firm*—Knobbe, Martens, Olson & Bear, LLP

(57) ABSTRACT

In a saddle for equestrian use, the saddle panels are secured within the saddle at their front and rear ends by screws driven into the saddle tree whereby the saddles can be detached from the saddle just by removal of the screws. Each panel is stiffened around its rear edge by wire or rod so that its edge is substantially self-supporting between the points of attachment defined by adjacent screws.

13 Claims, 2 Drawing Sheets

FOREIGN PATENT DOCUMENTS

| | | |
|---|---|---|
| DE | 94 11 519 | 11/1994 |
| DE | 199 47 304 | 4/2001 |
| EP | 0 060 449 | 9/1985 |
| EP | 0 328 376 | 10/1991 |
| EP | 0 764 607 | 5/2000 |
| FR | 2 632 623 | 12/1989 |
| FR | 2 667 584 | 4/1992 |
| GB | 434459 | 9/1935 |
| GB | 1 453 810 | 10/1976 |
| GB | 2 090 512 | 7/1982 |
| GB | 2 108 362 | 5/1983 |
| GB | 2 259 436 | 3/1993 |
| GB | 2 279 546 | 1/1995 |
| GB | 2 282 742 | 4/1995 |
| GB | 2 304 521 | 3/1997 |
| GB | 2 308 799 | 7/1997 |
| GB | 2 336 092 | 10/1999 |
| WO | PCT/US92/04279 | 11/1993 |
| WO | PCT/US97/24134 | 7/1998 |
| WO | PCT/DK98/00371 | 4/1999 |

* cited by examiner

SADDLES

RELATED APPLICATIONS

This application claims the benefit of the Australian Patent Application PS1723/02 filed Apr. 12, 2002.

BACKGROUND OF THE INVENTION

1) Field of the Invention

The present invention relates to saddles for equestrian use.

2) Description of the Prior Art

A conventional English-style equestrian saddle includes a panel assembly comprising a pair of panels which lie at the underside of the saddle and are of a compressible structure intended to spread the weight of the rider over the back of the horse. Conventionally, the panels consist of an envelope into which a packing of wool or comparable synthetic material is inserted by hand. In our U.S. Pat. No. 6,481,189, there is disclosed an improved panel assembly in which in addition to the packing, the panels also contain air bags. Either in conventional saddles in which the panels just contain packing or in our improved panels which contain air bags and packing, it is sometimes necessary for saddlers to adjust the fit of the saddle on the horse either by adjusting the positioning of the packing or by repacking. In practice, this will require removal of the panel assembly from the remainder of the saddle.

Conventionally, the panel assembly is incorporated into the structure of the saddle by attachment at its rear part and forward ends. At its rear part, it is conventionally "laced in" by stitching to the back of the seat around the rear part of the saddle; alternatively, staples may be used instead stitches. A variety of different techniques have been used for attaching the panel assembly at its forward ends; one of the several techniques involves the use of screws extending into the saddle tree. Even if screws are used to attach the forward ends of the panel assembly and which enable easy release of the forward ends, substantial difficulties still remain in removing the attachment at the rear part of the panel assembly in order to detach the panel assembly. Irrespective of whether it is attached by stitches or staples at the rear part, it can be quite difficult and time-consuming to remove and replace and a reasonable degree of skill is necessary to ensure satisfactory replacement.

SUMMARY OF THE INVENTION

According to the present invention there is provided a saddle having a seat and panels, each panel being stiffened along a rear edge portion which lies adjacent the rear of the seat, said stiffening being provided by a stiffening insert associated with the rear edge portion, said rear edge portion being attached to the saddle by releasable attachment means spaced along the edge portion, the stiffening providing support for said edge portion between adjacent points of attachment.

In a preferred embodiment of the invention, attachment is effected by screws extending through the edge portion in the zone of the stiffening and anchored to a saddle tree internally of the seat. The screws may extend through the stiffening or through the edge portion of the panel in close proximity to the stiffening.

The stiffening insert may consist of a wire or rod of rigid or semi-rigid material and, preferably, located within a tubular pocket formed around the rear edge portion.

Advantageously the rear edge portion is anchored only at a forward end at the side of the saddle and a rear end which lies at a central part of the saddle at the very rear end thereof.

Particularly advantageously the two panels are combined into a panel assembly and a single stiffening insert is associated with the rear edge portion of the panel assembly. In this form, the stiffening insert comprises a wire or rod bent into approximately U-shape and extending around the rear edge portion, the wire or rod being incorporated within a pocket stitched around the rear edge portion of the panel assembly. In this form, the panel assembly is secured in the centre part of its rear edge portion by at least one screw driven into the saddle tree in close proximity to the stiffening wire or rod; in this case, the panel assembly may be formed with additional stiffening material through which the screw is driven. Each panel is preferably also secured at its front end portion by one or more screws driven into the saddle tree.

According to another aspect of the present invention there is provided a saddle having a seat and panels, wherein a rear edge portion of each panel lying adjacent the rear of the seat is formed of relatively flexible material which is stiffened by the inclusion of a stiffening element of a relatively more rigid material, said rear edge portion being attached to the saddle by releasable attachment means spaced along the edge portion, the stiffening providing support for said edge portion between adjacent points of attachment.

According to yet another aspect of the invention there is provided a saddle including a seat and saddle panels, wherein the saddle panels are secured at front and rear end portions by screws anchored to a saddle tree whereby the saddle panels can be detached from the saddle by removal of the screws, each saddle panel being stiffened around its rear edge portion by wire or rod so that the edge portion is substantially self-supporting between points of attachment defined by adjacent screws.

BRIEF DESCRIPTION OF THE DRAWINGS

An embodiment of the invention will now be described by way of example only with reference to the accompanying drawings in which.

DESCRIPTION OF THE PREFERED EMBODIMENTS

Figure 1:
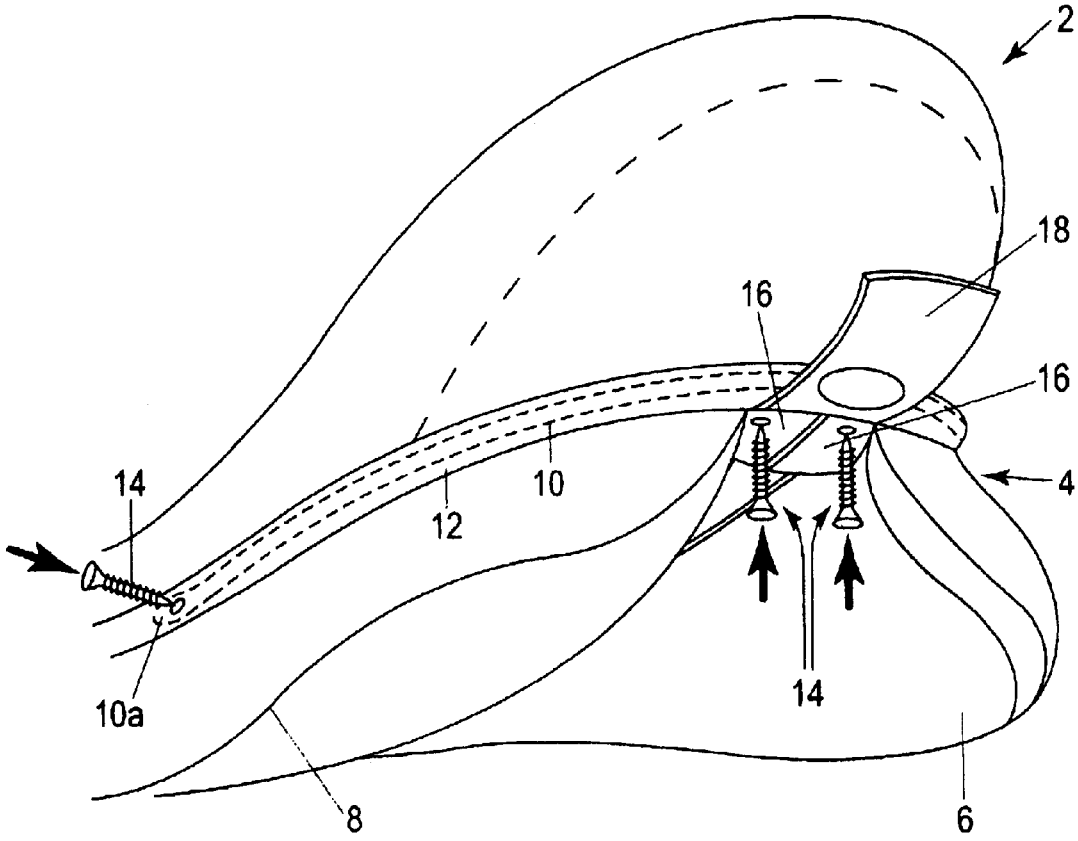
FIG. 1 is a schematic view showing the rear end portion of a saddle in accordance with the preferred embodiment of the invention.
Figure 2:
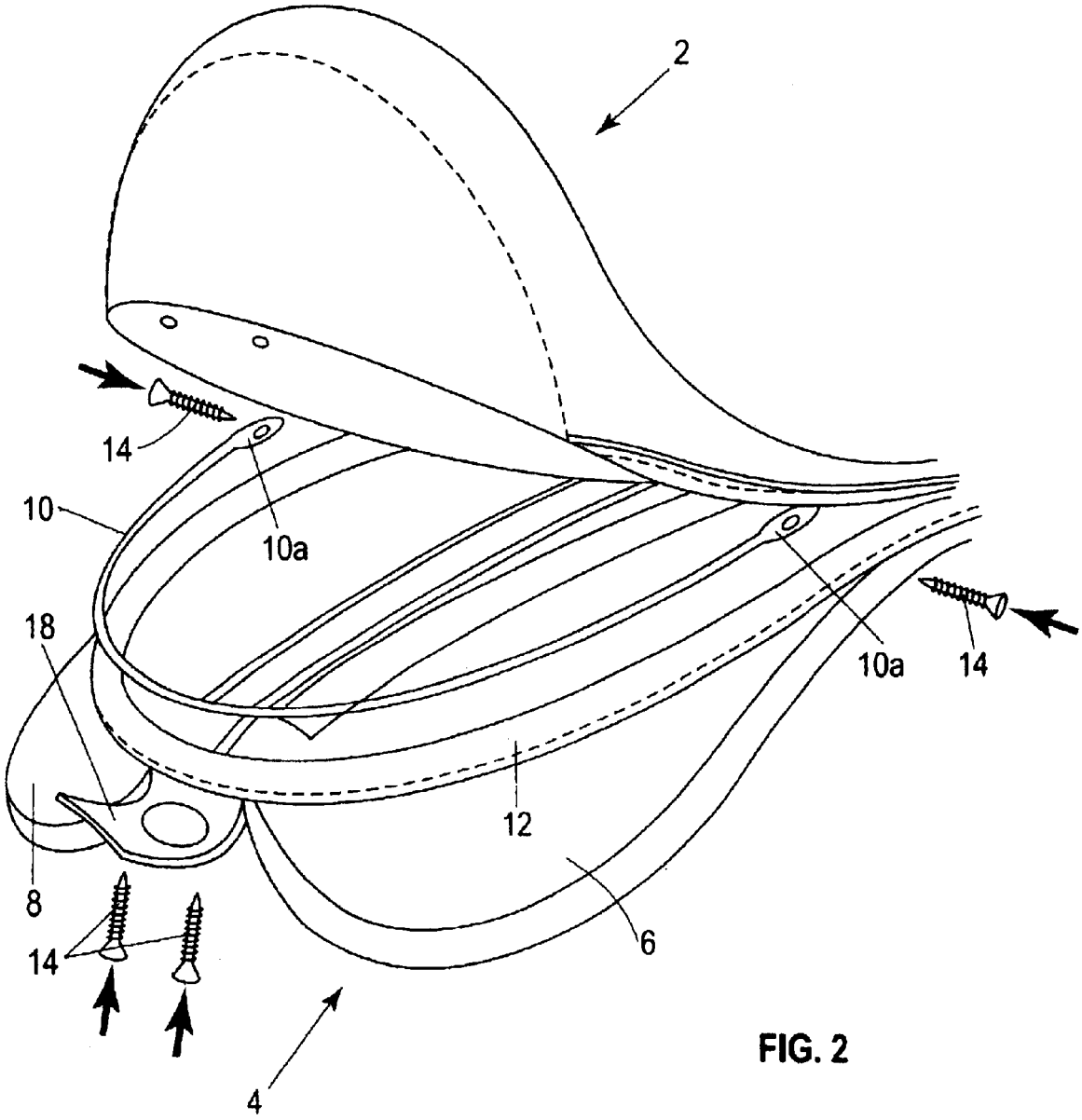
FIG. 2 is an exploded view corresponding to FIG. 1 but viewed from the opposite side of the saddle.

FIGS. 1 and 2 show the rear part of the saddle in accordance with the preferred embodiment of the invention. The saddle is basically of known construction save for the means of attachment of the rear part of the part of the panel assembly. As such, FIGS. 1 and 2 show the rear part of a seat 2 having within its interior a saddle tree, and a panel assembly 4 comprising panels 6, 8 containing packing in conventional manner, or packing and air bags as described in our U.S. Pat. No. 6,481,189 which is incorporated herein in its entirety by reference. The panel assembly is formed from leather, synthetic materials, or a combination of leather and synthetic materials. Around its rear edges, the panel assembly 4 is normally relatively flexible and it is this relatively flexible edge portion which is normally laced in or stapled to the back of the seat around the rear of the saddle. In contrast, in accordance with the preferred embodiment of the present invention, this rear edge portion is substantially stiffened by the incorporation of an element 10 of rigid or semi-rigid material of approximately U-shape extending around the rear part of the panel assembly between positions at opposite sides of the rear part as shown in the drawings.

The stiffening element 10 may comprise a stiff wire or rod bent into the required shape. In the preferred embodiment, the stiffening element 10 is received within a tubular pocket 12 formed by a strip of binding material stitched-in around the rear edge of the panel assembly. The incorporation of the stiffening element 10 into the rear edge of the panel assembly enables the number of fixing points between the rear edge of the panel assembly and the rear of the seat to be significantly reduced, as the stiffness of the edge renders the edge effectively self-supporting between adjacent fixing points. In particular it is only necessary to have points of attachment at the opposite ends of the stiffening element and in the centre part of the stiffening element at the very rear of the seat. Attachment is advantageously effected by screws 14 driven into the saddle tree (or related structure) at these points.

The attachment screws 14 may pass directly through the stiffening element 10 provided the element is appropriately formed to permit this, or alternatively the screws may pass through the structure of the panel assembly immediately adjacent the stiffening element 10; in this latter case, that part of the edge portion of the panel assembly will include additional reinforcement, for example by additional flaps of leather or other suitably stiff synthetic material stitched into the structure in that zone to ensure a firm and effectively rigid attachment in that zone provided by the combined effects of the stiffening element, the screw(s) and the additional reinforcing material through which the screw(s) passes immediately adjacent the stiffening element.

In the particular embodiment shown, the stiffening element 10 formed from rod or wire is flattened at each end 10*a* with an aperture to permit passage of the fastening screw 14 directly through the aperture and into the saddle tree to provide a firm anchorage. In the centre part of the rear edge which lies to the very back of the seat, the edge portion is provided with reinforcing flaps 16 stitched into the panel structure in close proximity to the pocket 12 and fastening screws are driven through each of these flaps into the saddle tree. In this regard, it is to be noted that in practice each of the panels is separately fabricated and then the two panels are stitched together to form the panel assembly, with the tubular pocket 12 being stitched in at that time. With this structure, each of the panels is fabricated with one of the two reinforcing flaps 16 which extends inwardly from the zone of the panel having the packing, and on assembly of the two panels, the two flaps 16 are stitched together to form effectively a single reinforcing zone bridging the two panels. With this structure, it is preferred to use two screws 14 in this zone, each screw passing through a respective one of the two flaps 16, although with other arrangements it is conceivable that only a single fixing screw may be required. As will be seen from FIG. 1, the screws 14 associated with the flaps 16 lie in the area of the underside of the panel assembly between the parts of the panels shaped by the packing. This area of the underside of the panel assembly preferably also includes a tab 18 which will normally cover the screws but which can be raised to expose the screws.

At its front ends, the panel assembly is preferably attached by screwing to the saddle tree, preferably using just two screws, one at each side of the forward end of the panel assembly.

In order to detach the panel assembly, all that is necessary is to remove the several screws attaching the panel assembly at its forward and rear end portions and this can be done very quickly. Although a screw attachment is known for the forward ends of the panel assembly and enabled quick detachment and reattachment, substantial effort was previously involved to detach and reattach the rear end portion of the panel assembly for the reasons previously discussed. With the embodiment now described, all that is necessary to detach the rear end portion is the removal of the fixing screws associated with the stiffening element, that is four, or possibly only three, screws in the configuration shown. Reattachment of the panel assembly following repacking or adjustment of the existing packing is accomplished just by the application of the screws, likewise requiring no particular skills.

Although in the embodiment described, the two panels are combined to form a panel assembly which is stiffened around its rear edge portion by a single stiffening member, in an alternative each panel may be separately applied to the saddle, with the rear edge portion of each panel being stiffened by a separate stiffening element broadly in the manner described so that the panel assembly is then formed in situ on the saddle. In this construction, the separate stiffening element associated with each panel may extend only to the centre part of the back of the seat and the stiffening element at that end may be flattened and apertured to receive the fastening screw.

The embodiment has been described by way of example only and modifications are possible within the scope of the invention.

What is claimed is:

1. A saddle having a seat and panels, each panel being stiffened along a rear edge portion which lies adjacent the rear of the seat, said stiffening being provided by a stiffening insert associated with the rear edge portion, said rear edge portion being attached to the saddle by releasable attachment means along the rear edge portion, the stiffening providing support for said edge portion between adjacent points of attachment.

2. A saddle according to claim 1, wherein the releasable attachment means comprise screws extending through the edge portion of the zone of the stiffening and anchored to a saddle tree internally of the seat.

3. A saddle according to claim 2, wherein the stiffening insert comprises a wire or rod of rigid or semi-rigid material.

4. A saddle according to claim 3, wherein the stiffening insert is located within a tubular pocket formed around the rear edge portion of the panel.

5. A saddle according to claim 3, wherein the rear portion of each panel is anchored only at a forward end at the side of the saddle and a rear end which lies at a central part of the saddle at the rear end thereof.

6. A saddle according to claim 2, wherein two panels are combined into a panel assembly and a single stiffening insert is associated with the rear portion of the panel assembly.

7. A saddle according to claim 6, wherein the stiffening insert comprises a wire or rod bent into approximately U-shape and extending around the rear edge portion of the panel assembly.

8. A saddle according to claim 7, wherein the panel assembly is secured in the centre part of the rear edge portion by at least one screw driven into the saddle tree in close proximity to the stiffening wire or rod.

9. A saddle according to claim 8, wherein the panel assembly has additional stiffening material which the screw is driven.

10. A saddle according to claim 8, wherein each panel of the panel assembly is also secured at its front end portion by one or more screws driven into the saddle tree.

11. A saddle having a seat and panels, wherein a rear portion of each panel lying adjacent the rear of the seat is formed of relatively flexible material which is stiffened by the inclusion of a stiffening element of a relatively more rigid material, said rear edge portion being attached to the saddle by releasable attachment means spaced along the edge portion, the stiffening providing support for said edge portion between adjacent points of attachment.

12. A saddle having a seat, a saddle tree and panels, wherein the panels are secured within the saddle at their front and rear end portions by screws anchored to the saddle tree whereby the panels can be detached from the saddle just by removal of the screws, each saddle panel being stiffened around its rear edge portion by wire or rod so that the rear edge portion is substantially self-supporting between points of attachment defined by adjacent screws.

13. A saddle according to claim 12, wherein the panels are combined into a panel assembly and a single wire or rod stiffens the rear edge portions of both panels.

* * * * *